US007501911B2

(12) United States Patent
Hong et al.

(10) Patent No.: US 7,501,911 B2
(45) Date of Patent: Mar. 10, 2009

(54) VERTICAL COMB ACTUATOR RADIO FREQUENCY MICRO-ELECTRO-MECHANICAL SYSTEM SWITCH

(75) Inventors: Young-tack Hong, Suwon-si (KR); Seok-chul Yun, Yongin-si (KR); Seok-mo Chang, Incheon (KR); Sang-wook Kwon, Seongnam-si (KR); Che-heung Kim, Yongin-si (KR); Jong-seok Kim, Taean-eup (KR); Hee-moon Jeong, Yongin-si (KR); Sang-hun Lee, Seoul (KR); Jun-o Kim, Yongin-si (KR); In-sang Song, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 322 days.

(21) Appl. No.: 11/417,242

(22) Filed: May 4, 2006

(65) Prior Publication Data

US 2007/0024390 A1 Feb. 1, 2007

(30) Foreign Application Priority Data

Jul. 29, 2005 (KR) ..... 10-2005-0069374

(51) Int. Cl.
*H01P 1/15* (2006.01)

(52) U.S. Cl. ..... 333/105; 333/262

(58) Field of Classification Search ..... 333/105, 333/262, 101; 200/181
See application file for complete search history.

(56) References Cited

U.S. PATENT DOCUMENTS 5,278,368 A * 1/1994 Kasano et al. ..... 200/181
6,310,526 B1 * 10/2001 Yip et al. ..... 333/262
6,621,387 B1 * 9/2003 Hopcroft ..... 333/262
6,657,525 B1 12/2003 Dickens et al.
6,914,711 B2 7/2005 Novotny et al.
6,949,985 B2 * 9/2005 Qiu et al. ..... 333/105
2005/0057329 A1 3/2005 Shen et al.

FOREIGN PATENT DOCUMENTS

JP 10-228853 A 8/1998
JP 2003-522377 A 7/2003
JP 2005-166622 A 6/2005
WO 01/57899 A1 8/2001
WO 2004/097910 A2 11/2004

* cited by examiner

*Primary Examiner*—Benny Lee
*Assistant Examiner*—Alan Wong
(74) *Attorney, Agent, or Firm*—Sughrue Mion, PLLC

(57) ABSTRACT

A vertical comb actuator radio frequency (RF) micro-electro-mechanical system (MEMS) switch. The RF MEMS switch includes a substrate; first and second signal lines spaced at a predetermined interval from each other and deposited on an upper surface of the substrate; an actuator positioned over the first and second signal lines when viewed from the upper surface of the substrate and spaced at a predetermined interval from the first and second signal lines; and a fixing portion positioned over the actuator when viewed from the upper surface of the substrate, wherein the fixing portion permits the actuator to come in contact with the first and second signal lines when a predetermined driving voltage is applied. Thus, it is possible to prevent the actuator from sticking to the substrate. In addition, the RF MEMS switch can be operated with a low voltage and insertion loss and power loss can be reduced.

16 Claims, 5 Drawing Sheets

VERTICAL COMB ACTUATOR RADIO FREQUENCY MICRO-ELECTRO-MECHANICAL SYSTEM SWITCH

CROSS-REFERENCE TO RELATED APPLICATIONS

This application claims priority from Korean Patent Application No. 10-2005-0069374, filed Jul. 29, 2005 in the Korean Intellectual Property Office, the entire contents of which are incorporated herein by reference.

BACKGROUND OF THE INVENTION

1. Field of the Invention

Apparatuses consistent with the present invention relate in general to a radio frequency (RF) micro-electro-mechanical system (MEMS) switch, and more particularly, to an RF MEMS switch in which electrostatic force is generated between a fixing portion and an actuator so that the actuator is prevented from sticking to a substrate.

2. Description of the Related Art

A MEMS refers to a device or system in which electric components and mechanical components are combined in a small structure. An RF MEMS refers to an RF device or system having the MEMS. The MEMS increases performance, the number of functions, and integration of the RF device, and lowers size, price, volume, and power consumption.

Generally, electronic systems operated in a high-frequency band have been developed to have a small size and weight and high performance. Accordingly, semiconductor switches, such as field effect transistor (FET) switches or pin diodes, which have been used to control signals in such systems have several drawbacks associated with bandwidth, isolation, insertion loss, power consumption, and linearity. Insertion loss refers to an RF signal transmission with a loss when a switch is turned on, and isolation refers to non-transmission of an RF signal when a switch is turned off. Linearity refers to the uniformity of a ratio of output power to input power.

The MEMS switch exhibits excellent characteristics over a very broad bandwidth. Particularly, the MEMS switch has a very broad available frequency band, a highly excellent isolation characteristic, and much less insertion loss and power consumption.

A switch is widely used as an RF device using an MEMS technique. RF switches have been applied to selective signal transmission circuits and impedance matching circuits in wireless communication terminals and systems operated in microwave or millimeter wavebands.

FIG. 1 illustrates an example of a conventional RF MEMS switching device.

Referring to FIG. 1, the RF MEMS switching device 10 comprises a semiconductor substrate 11, a pair of signal lines 13 formed on the substrate 11, and an interconnect 15 connecting between the signal lines 13.

An RF signal input through one of the signal lines 13 is delivered to the other signal line 13 through the interconnect 15. The interconnect 15 is driven by an external driving force, such as an electrostatic force, and comes in contact with the signal lines 13 or out of contact with the signal lines 13. Thus, the transmission of the RF signal through the signal lines 13 is realized by the interconnect 15.

Since the interconnect 15 is fabricated in close relation with the substrate 11 as described above, the interconnect 15 and the substrate 11 may be stuck to each other when a sacrifice layer between the interconnect 15 and the substrate 11 is removed. Further, both ends of the interconnect 15 come in contact with the signal lines 13. This obstructs the reduction of contact resistance and in turn increases insertion loss and power consumption.

SUMMARY OF THE INVENTION

Accordingly, it is an aspect of the present invention to provide an RF MEMS switch, which generates an electrostatic force between a fixing portion and an actuator so that the actuator is prevented from sticking to the substrate, uses a comb actuator structure so that the switch is driven with a low voltage, and has one contact point so that insertion loss and power loss are reduced.

In an exemplary embodiment, the present invention provides an RF MEMS switch, including: a substrate; first and second signal lines spaced at a predetermined interval from each other and deposited on an upper surface of the substrate; an actuator positioned over the first and second signal lines when viewed from the upper surface of the substrate and spaced at a predetermined interval from the first and second signal lines; and a fixing portion positioned over the actuator whep being viewed from the upper surface of the substrate, wherein the fixing portion permits the actuator to come in contact with the first and second signal lines when a predetermined driving voltage is applied.

The actuator and the fixing portion may have a comb structure and be engaged with each other.

The actuator may perform a switching operation in a bridge form.

The RF MEMS switch may further include another substrate bonded to the substrate for fixing the fixing portion.

The fixing portion may include a support fixed on another substrate, and teeth supported on the support.

In accordance with another exemplary embodiment of the present invention, there is provided an RF MEMS switch, including: a substrate; first and second signal lines spaced at a predetermined interval from each other and deposited on an upper surface of the substrate; an actuator that is integral with the first signal line and spaced at a predetermined interval from the upper surface of the substrate; and a fixing portion positioned over the actuator when being viewed from the upper surface of the substrate, wherein the fixing portion permits the actuator to come in contact with the second signal line at one contact point when a predetermined driving voltage is applied.

The actuator and the fixing portion may have a comb structure and be engaged with each other.

The actuator may be supported by the first signal line.

The actuator may perform a switching operation in a cantilever form.

The RF MEMS switch may further include another substrate bonded to the substrate for fixing the fixing portion.

The fixing portion may include a support fixed on another substrate, and teeth supported on the support.

BRIEF DESCRIPTION OF THE DRAWINGS

The above aspects of the present invention will be more apparent by describing certain exemplary embodiments of the present invention with reference to the accompanying drawings, in which.

DETAILED DESCRIPTION OF EXEMPLARY, NON-LIMITING EMBODIMENTS

Hereinafter, exemplary embodiments of the present invention will be described with reference to the accompanying drawings.

Figure 1:
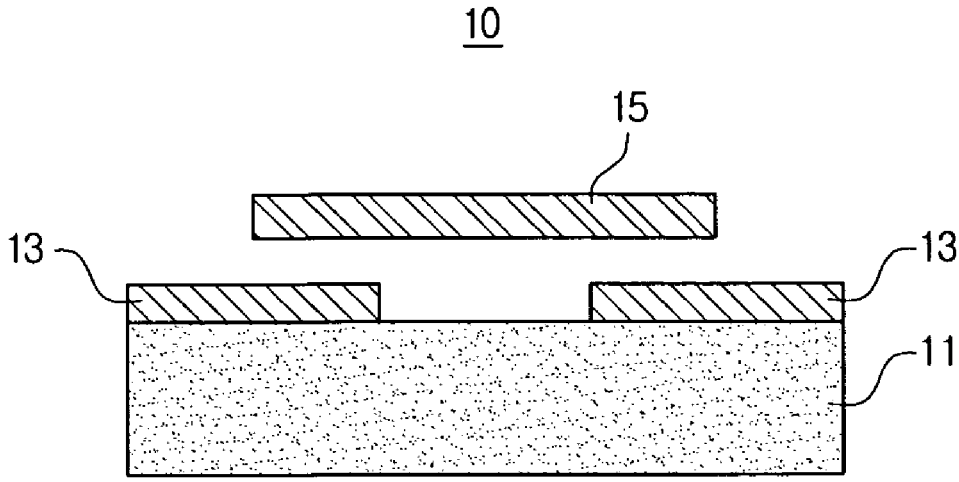
FIG. 1 (PRIOR ART)
FIG. 1 illustrates an example of a conventional RF MEMS switching device.
Figure 2A:
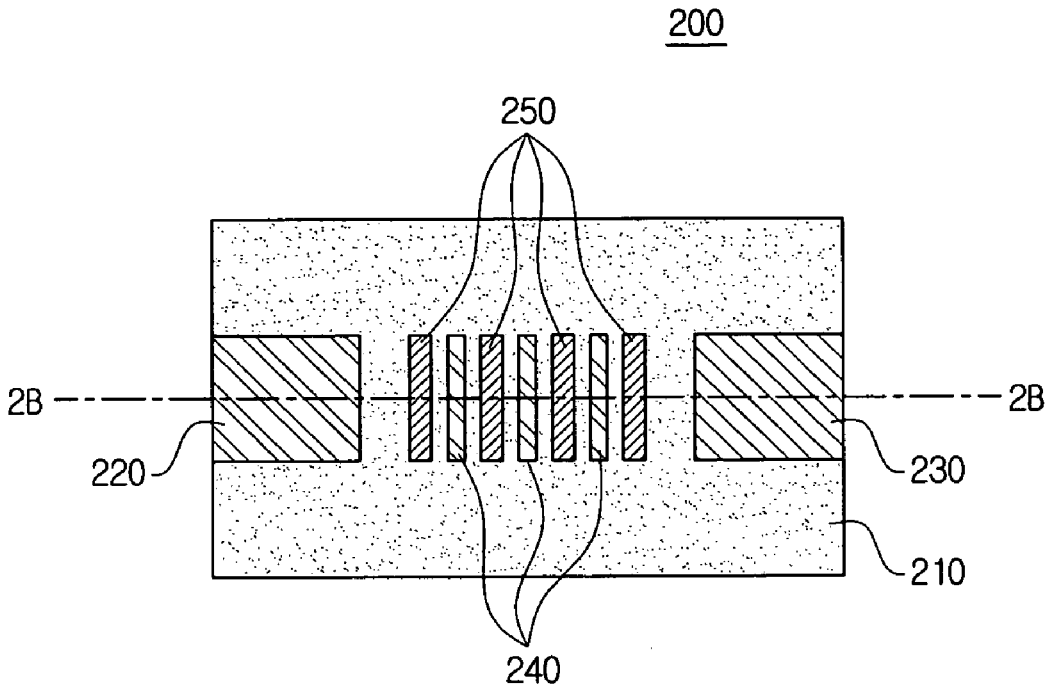
FIG. 2A is a plan view illustrating the structure of an RF MEMS switch according to an exemplary embodiment of the present invention.
Figure 2B:
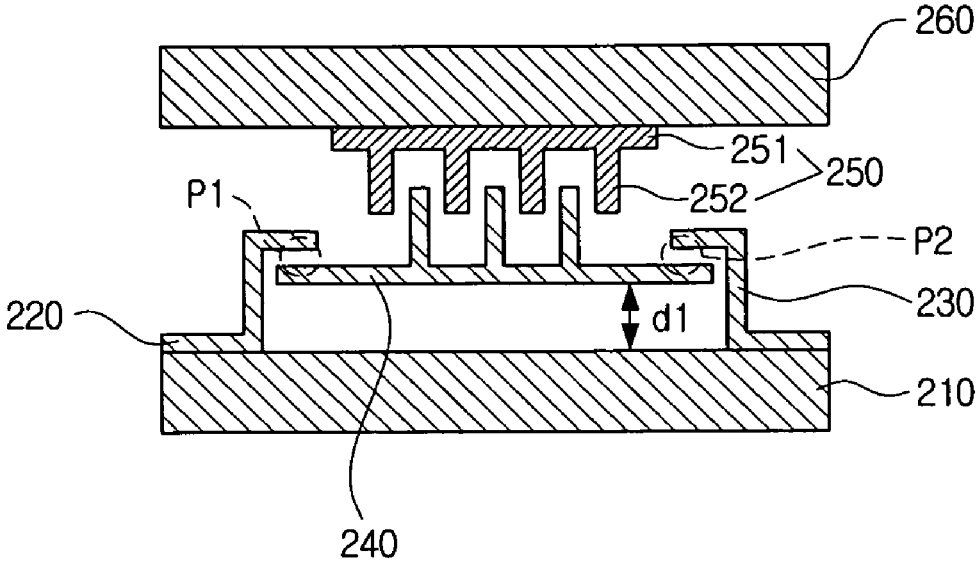
FIG. 2B is a vertical-sectional view taken along line 2B-2B of FIG. 2A.

FIG. 2A is a plan view illustrating the structure of an RF MEMS switch according to an exemplary embodiment of the present invention, and FIG. 2B is a vertical-sectional view taken along line 2B-2B of FIG. 2A.

Referring to FIGS. 2A and 2B, the RF MEMS switch 200 comprises a lower substrate 210, a first signal line 220, a second signal line 230, an actuator 240, a fixing portion 250, and an upper substrate 260.

The first signal line 220 and the second signal line 230 are spaced at a predetermined interval from each other and are deposited on the lower substrate 210. The actuator 240 is spaced at a predetermined interval d1 from the lower substrate 210. That is, the actuator 240 performs a switching operation in a bridge form. Further, the actuator 240 has a comb structure in an upward direction.

If the RF MEMS switch 200 is turned on, the actuator 240 comes in contact with the first signal line 220 and the second signal line 230 at contact points P1 and P2. The fixing portion 250 includes a support 251 fixed to the upper substrate, and teeth 252 supported on the support 251.

The fixing portion 250 has a comb structure in a downward direction. When a predetermined driving voltage is applied, the teeth 252 of the fixing portion 250 are engaged with the teeth of the actuator 240. The fixing portion 250 is fixed to the upper substrate 260 and the actuator 240 is driven in up and down directions.

If a predetermined driving voltage is applied between the actuator 240 and the fixing portion 250, electrostatic force is generated therebetween and the fixing portion 250 attracts the actuator 240. Accordingly, the actuator 240 comes in contact with the first signal line 220 and the second signal line 230 at the contact points P1 and P2

As the actuator 240 comes in contact with the first signal line 220 and the second signal line 230, the RF MEMS switch 200 is turned on.

Since the actuator 240 and the fixing portion 250 form a comb structure, an interval therebetween is narrow and the RF MEMS switch 200 can be turned on with a smaller driving voltage, compared to a conventional RF MEMS switch.

If the actuator 240 and the fixing portion 250 do not form such a comb structure, a higher driving voltage is needed, but the actuator 240 can be prevented from sticking to the substrate 210 upon fabrication of the RF MEMS switch.

According to an exemplary embodiment of the present invention, it is possible to prevent the actuator from sticking to the substrate upon fabrication of the RF MEMS switch since an interval d1 of a sacrifice layer can be increased over a conventional case upon fabrication of the actuator 240.

Figure 3A:
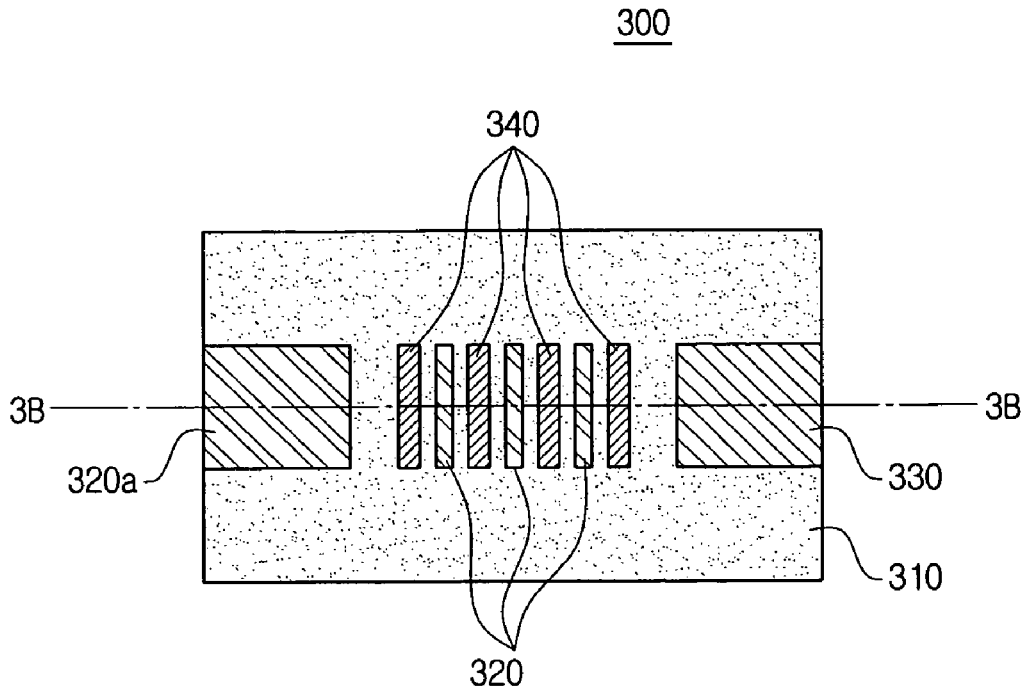
FIG. 3A is a plan view illustrating the structure of an RF MEMS switch according to another exemplary embodiment of the present invention.
Figure 3B:
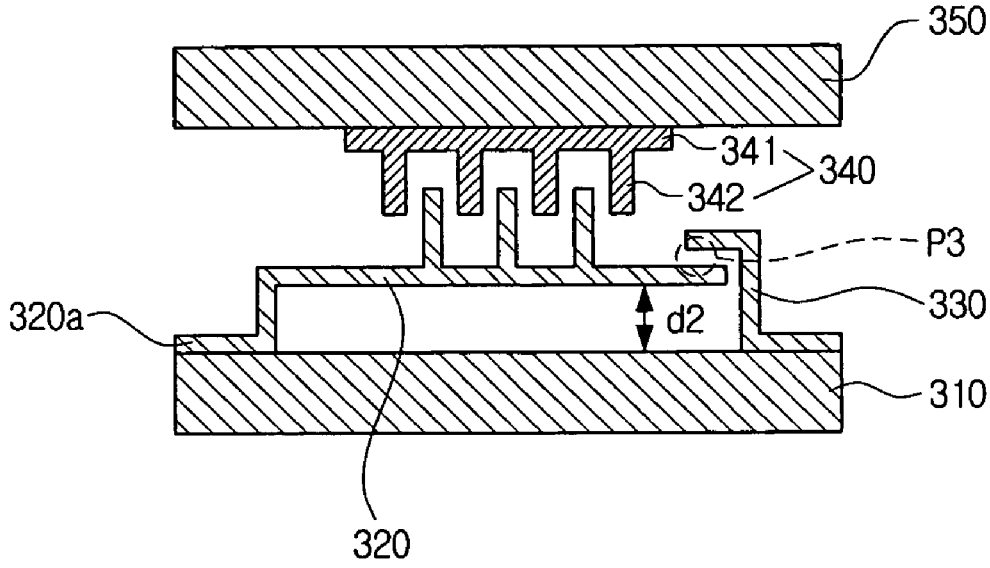
FIG. 3B is a vertical-sectional view taken along line 3B-3B of FIG. 3A.

FIG. 3A is a plan view illustrating the structure of an RF MEMS switch according to another exemplary embodiment of the present invention, and FIG. 3B is a vertical-sectional view taken along line 3B-3B of FIG. 3A.

Referring to FIGS. 3A and 3B, the RF MEMS switch 300 comprises a lower substrate 310, an actuator 320, a second signal line 330, a fixing portion 340, and an upper substrate 350.

A first signal line 320*a* is deposited on the lower substrate 310. The actuator 320 is supported by the first signal line 320*a* and is integral with the first signal line 320*a*. The actuator 320 is spaced at a predetermined interval d2 from the lower substrate 310. That is, the actuator 320 is in the form of a cantilever to perform a switching operation. Further, the actuator 320 forms a comb structure in an upward direction.

The second signal line 330 is spaced at a predetermined interval from the first signal line 320*a* and deposited on the lower substrate 310. The second signal line 330 comes in contact with the actuator 320 at a contact point P3 when the RF MEMS switch 300 is turned on.

The fixing portion 340 includes a support 341 fixed to the upper substrate 350, and teeth 342 supported on the support 341.

The fixing portion 340 has a comb structure in a downward direction. The teeth 342 of the fixing portion 340 are engaged with the teeth of the actuator 320 when a predetermined driving voltage is applied. The fixing portion 340 is fixed to the upper substrate 350 and the actuator 320 is driven.

When a predetermined driving voltage is applied between the actuator 320 and the fixing portion 340, an electrostatic force is generated therebetween and the fixing portion 340 attracts the actuator 320. Accordingly, the actuator 320 comes in contact with the second signal line 330 at a contact point P3. As the actuator 320 comes in contact with the second signal line 330, the first signal line 320*a* is connected to the second signal line 330. Accordingly, the RF MEMS switch 300 is turned on.

Because the actuator 320 and the fixing portion 340 form the comb structure, an interval therebetween becomes narrow such that the RF MEMS switch may be turned on with a smaller driving voltage, compared to a conventional RF MEMS switch.

When the actuator 320 and the fixing portion 340 do not form the comb structure, a higher driving voltage is needed, but the actuator 320 can be prevented from sticking to the substrate 310 upon fabrication of the RF MEMS switch.

According to another exemplary embodiment of the present invention, it is possible to increases the interval d2 of the sacrifice layer compared to a conventional case upon fabrication of the actuator 320, thereby preventing the actuator 320 from sticking to the substrate upon fabrication of the RF MEMS switch. In addition, one contact point P3 exists, thereby reducing insertion loss and power consumption.

As described above, according to the exemplary embodiments of the present invention, an electrostatic force is generated between the fixing portion and the actuator, such that the actuator is prevented from sticking to the substrate. In addition, the actuator has a comb structure such that the switch may be driven with a low voltage.

In addition, the switch may comprise one contact point so that insertion loss and power loss are reduced.

The foregoing embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims. Many alternatives, modifications, and variations will be apparent to those skilled in the art.

What is claimed is:

1. A radio frequency (RF) micro-electro-mechanical system (MEMS) switch, comprising:

a substrate;

a first signal line and a second signal line spaced apart from each other and deposited on an upper surface of the substrate;

an actuator positioned to overlap a portion of the first signal line and to overlap a portion of the second signal line and spaced apart from the first signal line and the second signal line; and a fixing portion positioned over the actuator, wherein the fixing portion causes the actuator to come in contact with the first signal line and the second signal line when a predetermined driving voltage is applied, wherein at least one of the actuator and the fixing portion have a comb structure.

2. The RF MEMS switch as claimed in claim 1, wherein the actuator is in the form of a bridge so as to perform a switching operation.

3. The RF MEMS switch as claimed in claim 1, further comprising another substrate attached to the fixing portion.

4. The RF MEMS switch as claimed in claim 3, wherein the fixing portion comprises a support fixed on another substrate, and teeth supported on the support.

5. The RF MEMS switch as claimed in claim 1, wherein both the actuator and the fixing portion have a comb structure.

6. The RF MEMS switch as claimed in claim 5, wherein the actuator and the fixing portion are engaged with each other.

7. A radio frequency (RF) micro-electro-mechanical system (MEMS) switch, comprising:

a substrate;

a first signal line and a second signal line spaced apart from each other and deposited on an upper surface of the substrate;

an actuator that is integral with the first signal line and spaced apart from the upper surface of the substrate; and a fixing portion positioned over the actuator and spaced apart from the first signal line, wherein the fixing portion causes the actuator to come in contact with the second signal line at a contact point when a predetermined driving voltage is applied.

8. The RF MEMS switch as claimed in claim 7, wherein at least one of the actuator and the fixing portion have a comb structure.

9. The RF MEMS switch as claimed in claim 7, wherein the actuator is supported by the first signal line.

10. The RF MEMS switch as claimed in claim 7, wherein the actuator is in the form of a cantilever so as to perform a switching operation.

11. The RF MEMS switch as claimed in claim 7, further comprising another substrate attached to the fixing portion.

12. The RF MEMS switch as claimed in claim 11, wherein the fixing portion comprises a support fixed on another substrate, and teeth supported on the support.

13. The RF MEMS switch as claimed in claim 8, wherein both the actuator and the fixing portion have a comb structure.

14. The RF MEMS switch as claimed in claim 13, wherein the actuator and the fixing portion are engaged with each other.

15. The RF MEMS switch as claimed in claim 7, wherein the fixing portion is not positioned over a first signal line segment of the actuator that is integral with the first signal line.

16. A radio frequency (RF) micro-electro-mechanical system (MEMS) switch, comprising:

a substrate;

a first signal line and a second signal line spaced apart from each other and deposited on an upper surface of the substrate;

an actuator positioned to overlap a portion of the first signal line and to overlap a portion of the second signal line and spaced apart from the first signal line and the second signal line; and a fixing portion positioned over the actuator, wherein the fixing portion attracts the actuator through electrostatic force to cause the actuator to come in contact with the first signal line and the second signal line when a predetermined driving voltage is applied.

* * * * *